US007304226B2

(12) United States Patent
Harris

(10) Patent No.: US 7,304,226 B2
(45) Date of Patent: Dec. 4, 2007

(54) STRINGED INSTRUMENT TUNING DEVICE

(76) Inventor: Timothy M Harris, 8540 Captains Ct., Indianapolis, IN (US) 46236

( * ) Notice: Subject to any disclaimer, the term of this patent is extended or adjusted under 35 U.S.C. 154(b) by 0 days.

(21) Appl. No.: 11/399,052

(22) Filed: Apr. 6, 2006

(65) Prior Publication Data

US 2007/0245878 A1 Oct. 25, 2007

(51) Int. Cl.
*G10D 3/14* (2006.01)

(52) U.S. Cl. ..... 84/304

(58) Field of Classification Search ..... 84/304, 84/305, 306, 290

See application file for complete search history.

(56) References Cited

U.S. PATENT DOCUMENTS

| | | | | |
|---|---|---|---|---|
| 4,062,265 | A * | 12/1977 | Walker | 84/312 R |
| 4,077,295 | A | 3/1978 | Zapp | |
| 4,151,778 | A * | 5/1979 | Beattie et al. | 84/306 |
| 4,735,124 | A * | 4/1988 | Bernier | 84/304 |
| 4,860,627 | A | 8/1989 | Sloane | |
| 4,970,930 | A | 11/1990 | Secord | |
| 5,696,341 | A | 12/1997 | McCane | |
| 6,172,287 | B1 | 1/2001 | Kang | |
| 6,784,353 | B1 | 8/2004 | Davis | |
| 2004/0060419 | A1 * | 4/2004 | Goto | 84/304 |

FOREIGN PATENT DOCUMENTS

| | | |
|---|---|---|
| DE | 19914369 | 10/2000 |
| GB | 175132 | 2/1922 |
| GB | B175132 | 2/1922 |
| GB | 239984 | 9/1925 |
| GB | 197585 | 5/1928 |

* cited by examiner

*Primary Examiner*—Kimberly Lockett
(74) *Attorney, Agent, or Firm*—Kyle S. Brant

(57) ABSTRACT

A stringed instrument tuning device is disclosed that is enhanced over the prior art by an included mechanism that enables the tuning knob to be positioned freely in any rotational position after a string has been tensioned or tuned. A worm gear drive tuning assembly typical of prior art tuning devices is employed. In one approach, the tuning device includes a common ratchet mechanism that enables free rotation of the tuning knob with respect to the tuning mechanism. In other embodiments disclosed, a spline shaft engagement mechanism is employed with a shuttle that releasably engages the tuning knob to the worm gear drive tuning assembly.

10 Claims, 6 Drawing Sheets

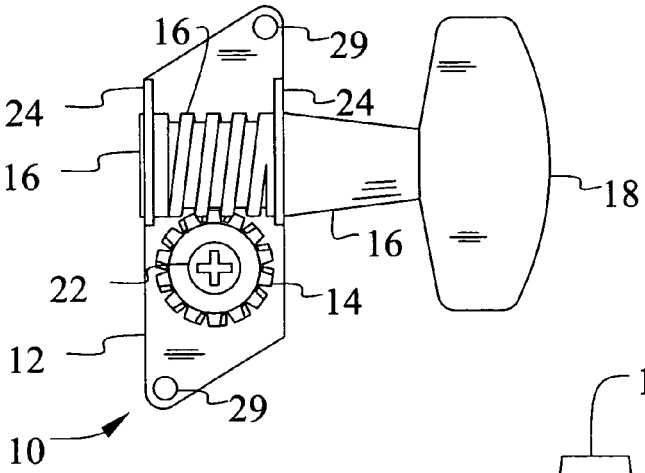
Fig. 1
Prior Art
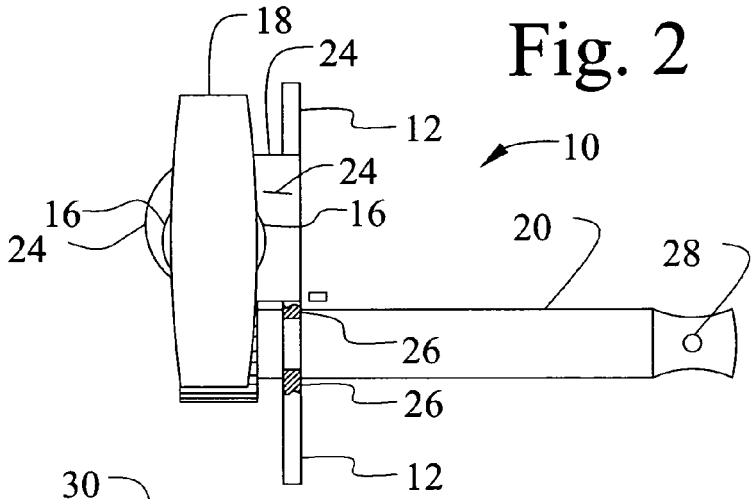
Fig. 2
Fig. 3
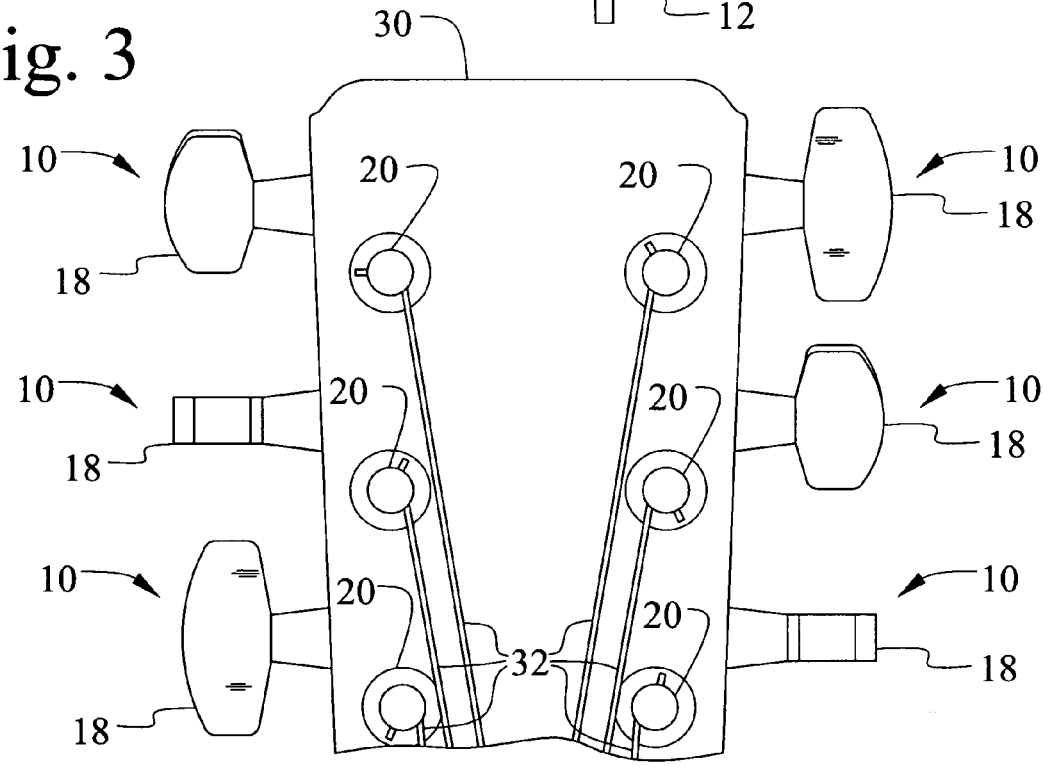

Fig 4
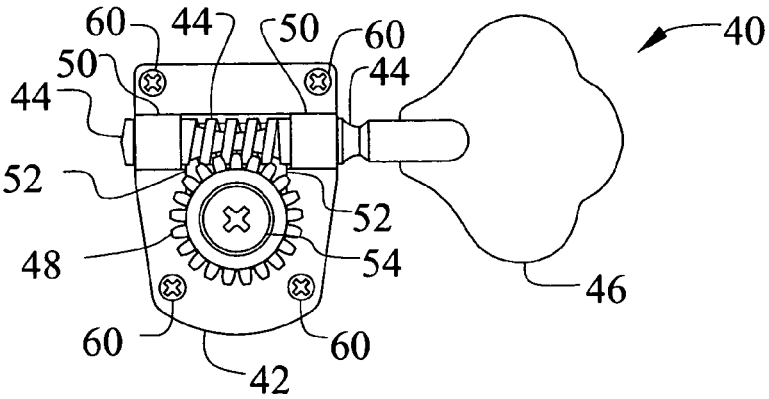
Prior Art
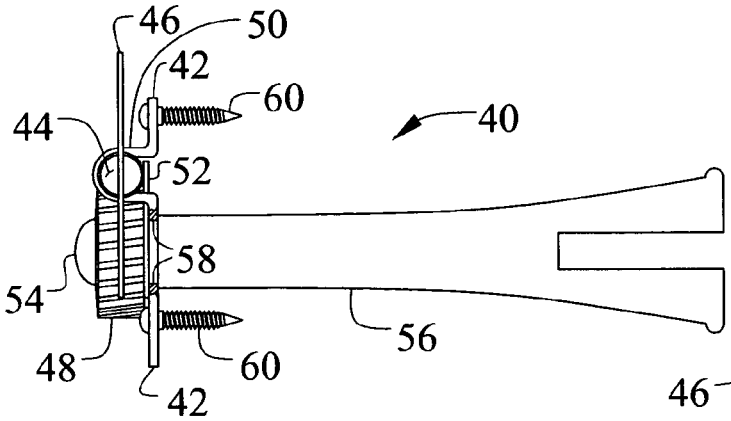
Fig 5
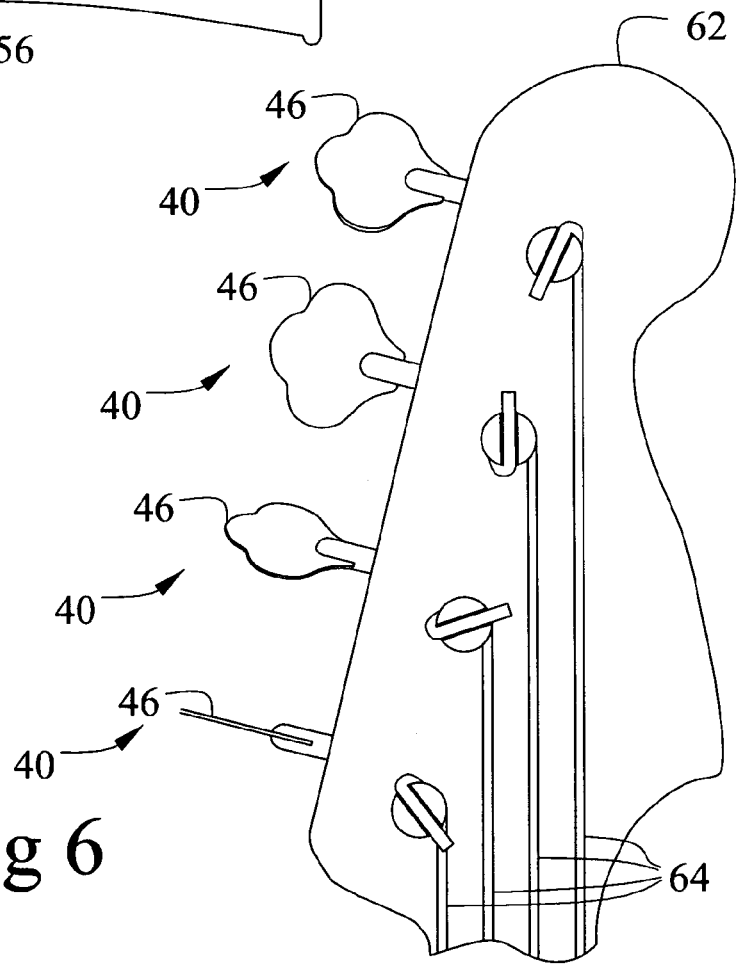
Fig 6

STRINGED INSTRUMENT TUNING DEVICE

FIELD OF THE INVENTION

This invention relates in general to stringed musical instrument and more specifically to tuning devices used with stringed instruments.

BACKGROUND OF THE INVENTION

A wide variety of stringed instruments are known, such as six and twelve string guitars, bass guitars, ukuleles, mandolins, sitars, banjos and the like. Tuning mechanisms for such stringed instruments are quite old in the art. Typically, a well known worm gear drive tuning mechanism is used to tension the strings wound about a tuning peg. A gear wheel is attached to the tuning peg and the gear wheel is driven by a worm gear mechanism. A common arrangement includes a piece of sheet metal formed into a U-shaped channel across which a worm gear is rotatably mounted. The worm gear engages a mating pinion gear that is directly attached to and rotates the tuning peg. Alternative arrangements are also known wherein the worm gear drive is secured in position by a sheet metal stamping having opposing mounting ears for receiving slots in the worm gear shaft. In order to enhance the appearance of the stringed instrument it is fairly common for the component parts of the tuning mechanism to be nickel plated, including a metal tuning handle or knob. After tensioning the strings using the tuning mechanism, the tuning handles or knobs are most likely not in the same rotational position. Thus, the visual appearance of the musical instrument is something less than desirable. What is needed is a tuning mechanism that provides a means to enable the tuning handles or knobs to be freely rotated after the strings of the stringed instrument have been tuned.

SUMMARY OF THE INVENTION

A stringed instrument tuning device according to one aspect of the present invention includes a pinion gear, a tuning shaft having a first end and a second end and wherein a transverse aperture is situated near the first end for receiving a wire string, a worm gear adapted to engage the pinion gear, a bracket having a first aperture therein, and wherein the second end of the tuning shaft is situated in the first aperture and the pinion gear is attached to the shaft so that the bracket is rotatably captured between the gear and the shaft, the bracket further including worm gear mounting means for rotatably attaching the worm gear to the bracket in a position to engage the pinion gear, means for rotating the worm gear, the means for rotating attached to the worm gear, the means for rotating positively engaging the worm gear in a first mode of operation, and wherein the means for rotating freely rotates with respect to the worm gear in a second mode of operation; and a tuning knob attached to the means for rotation.

One object of the present invention is to provide an improved tuning mechanism for use with stringed instruments.

Another object of the present invention is to provide a tuning mechanism that enables the user to freely rotate the tuning knobs after the strings are tensioned appropriately.

Yet another object of the present invention is to provide a tuning mechanism that includes a means for releasably engaging the worm gear drive from a tuning knob in a typical tuning mechanism.

Still another object of the present invention is to enable the user to align the tuning knobs in a specific fashion after the tuning procedure is completed so that accidental contact with the tuning knobs that results in detuning of the instrument is evidenced by visual misalignment of the tuning knobs and readily observed and corrected by the user.

These and other objects of the present invention will become more apparent from the following description of the preferred embodiments and the accompanying drawings.

BRIEF DESCRIPTION OF THE DRAWINGS

FIG. 1 is a partial cross-section front elevational view of a prior art stringed instrument tuning device used with a six string guitar.

FIG. 2 is a side elevational view of the prior art tuning device of FIG. 1.

FIG. 3 is a partial view of a six string guitar neck depicting typical tuning knob positions once the strings of a guitar are tuned and including the prior art tuning device of FIG. 1.

FIG. 4 is a plan view of a prior art stringed instrument tuning device used with a four string bass guitar.

FIG. 5 is a partial cross-section side elevational view of the prior art bass guitar string tuning device of FIG. 4.

FIG. 6 is a partial view of a four string bass guitar neck including the prior art device of FIG. 4 and depicting typical tuning knob positions once the strings of a guitar are tuned.

DESCRIPTION OF THE PREFERRED EMBODIMENTS

Figure 7:
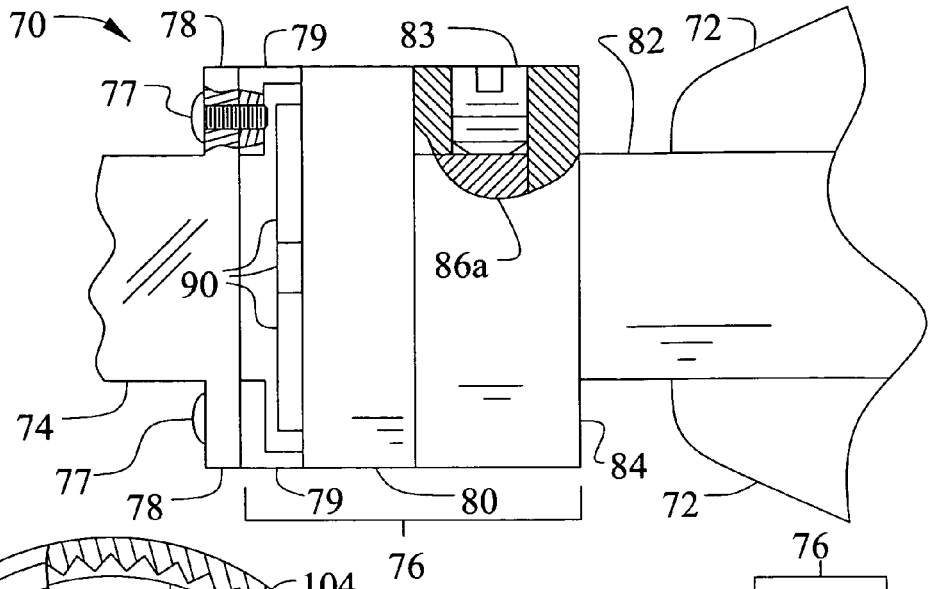
FIG. 7 is a partial elevational view of a stringed instrument tuning device according to one aspect of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to FIGS. 1-3, a prior art stringed instrument tuning device 10 is shown. FIG. 1 is a front elevational view and FIG. 2 is a partial cross-section side elevational view. Device 10 consists of a bracket 12, a pinion gear 14, a worm gear shaft 16, knob 18, tuning shaft 20 and a screw 22 that secures shaft 20 to gear 14 and sandwiches bracket 12 therebetween. Worm gear shaft 16 is rotatably disposed in mounting ears 24 formed in bracket 12 that include semi-circular openings (not shown) adapted to receive annular slots (not shown) in worm gear shaft 16 to rotatably retain worm gear shaft 16 in position. Tuning shaft 20 includes a shoulder portion at location 26 that is received in an aperture in bracket 12 as shown at 26. Screw 22 extends through an aperture (not shown) in gear 14 to engage internal threads (not shown) in shaft 20. Aperture 28 in tuning shaft 20 receives a metal stringed instrument wire (guitar string) or nylon string. Device 10 is attached to the neck of a stringed instrument via mounting holes 29 and tuning shaft 20 extends through holes (not shown) in the neck portion 30 of the stringed instrument as shown in FIG. 3.

As shown in FIG. 3, a typical six string guitar includes six tuning devices 10 attached to the neck 30 of a guitar. Strings 32 are inserted through and wound about tuning shafts 20. A typical end result of the tuning of a guitar is illustrated in FIG. 3. As a result of the rotation of knobs 18 to tension or tune strings 32, knobs 18 are now positioned at various angular positions, and as is typical, none of the knobs are in alignment with any other knobs.

Referring now to FIGS. 4-6, a common tuning device 40 of the prior art used with bass guitars is shown. FIG. 4 is a front elevational view and FIG. 5 is a partial cross-section side elevational view. Comparatively speaking, tuning device 40 includes slightly larger components to accommodate the larger strings of a bass guitar. Bracket 42 is stamped and formed to receive worm gear shaft 44. Tuning knob 46 is attached to worm gear shaft 44. Pinion gear 48 engages worm gear shaft 44 as shown. Bracket ears 50 provide a semi-circular mounting location that receives corresponding mating slots of worm gear shaft 44. Retainer plate 52 is situated between gear 48 and bracket 42 to retain worm gear shaft 44 adjacent bracket ears 50. Screw 54 extends through gear 48 and plate 52 to engage internal threads in tuning shaft 56. Tuning shaft 56 includes a shoulder portion at location 58 that is received in an aperture in bracket 42 as shown at 58. Gear 48 and tuning shaft 56 are rotatably attached to one another with bracket 42 therebetween so that rotation of tuning knob 46 imparts corresponding geared down rotation through worm gear shaft 44 and gear 48 to rotate tuning shaft 56. Mounting screws 60 are used to attach device 40 to the neck of a stringed instrument 62 as depicted in FIG. 6.

A quantity of four tuning devices 40 are attached to neck 62 of a stringed instrument such as a bass guitar as shown in the partial view of a guitar neck of FIG. 6. Again, as in FIG. 3, the end result of tuning the strings 64 is tuning knobs 46 are now misaligned. The devices shown in FIGS. 7-22 and described in detail below provide a mechanism to physically align the tuning knobs after string tuning or tensioning is completed.

Figure 8:
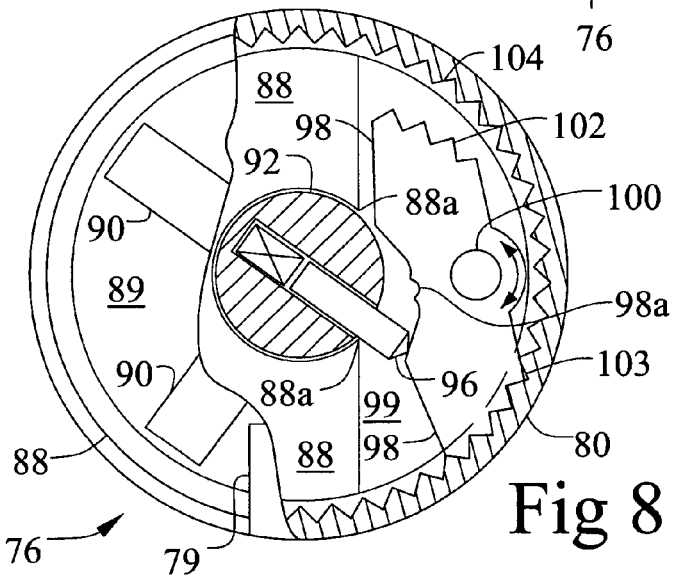
FIG. 8 is a partial cutaway internal view of the ratchet mechanism of the device of FIG. 7.
Figure 9:
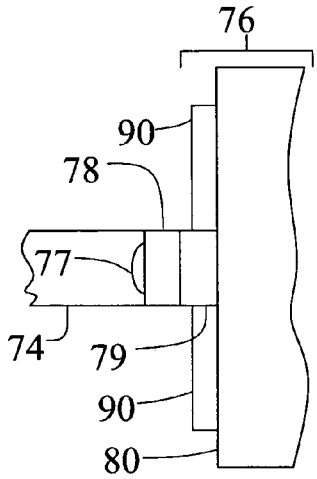
FIG. 9 is a rotated partial front elevational view of the device of FIG. 7.
Figure 10:
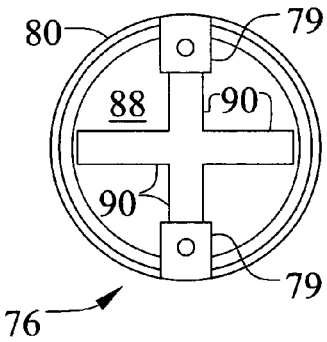
FIG. 10 is an end view of the ratchet mechanism of FIG. 7 detached from the worm gear shaft.
Figure 11:
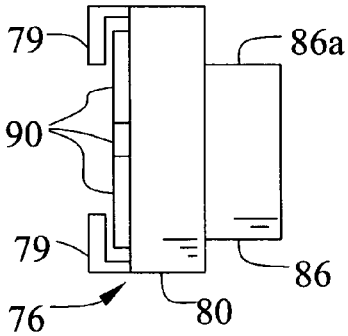
FIG. 11 is a side elevational view of the ratchet mechanism of FIG. 10.
Figure 12:
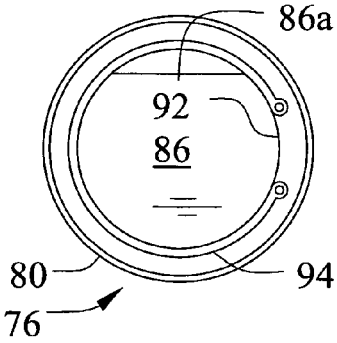
FIG. 12 is an end view of the ratchet mechanism of FIG. 10.

Referring now to FIGS. 7-12, a first embodiment of a stringed instrument tuning device 70 according one aspect of the present invention is shown. FIG. 7 is a partial cutaway front elevational view of device 70. FIG. 8 is a partial cutaway end view of ratchet mechanism 76. FIG. 9 is a partial plan view of ratchet 76 shown attached to shaft 74. FIG. 10 is a side elevational view of ratchet 76. FIG. 11 is a front elevational view of ratchet 76. FIG. 12 is a side elevational view of ratchet 76. Stringed instrument tuning device 70 is an improvement to the worm gear shaft of the prior art stringed instrument tuning devices and provides a mechanism whereby tuning knob 72 may be rotated freely without affecting the rotational position of worm gear shaft 74. Worm gear shaft 74 corresponds in functionality to worm gear shafts 16 and 44 of the prior art with a portion of the shaft 74 modified to include a releasably engaging drive means or ratchet mechanism 76 as discussed below. In a first mode of operation of ratchet 76 shaft 82 rotates freely with respect to shaft 74. In a second mode of operation of ratchet 76, tuning knob 72 is rotated and imparts rotational force directly to worm gear shaft 74 through ratchet 76. Shaft 74 is attached to ratchet mechanism 76, a device well known in the art of hand tools (further specific details of a functionally similar device are found in U.S. Pat. No. 4,147,076, hereinafter incorporated by reference) via screws 77. Shaft 74 is attached to ratchet mechanism 76 via screws 77 that engage mating mounting ears 78 and 79 disposed on shaft 74 and ratchet mechanism 76, respectively. Mounting ears 79 are integrally formed in the housing 80 of ratchet 76. Mounting ears 78 are formed as a part of shaft 74. Tuning knob 72 is fixedly attached to shaft 82. Shaft 82 includes a shaft adapter 84 attached via set screw 83 to output shaft 86 of ratchet 76. Ratchet directional control is achieved via partial rotational positioning of knob 89 with respect to pawl carrier 88 to engage clockwise drive, counterclockwise drive, or free rotation of shaft 82 with respect to shaft 74. Pawl carrier 88 is rotatably disposed within housing 80. Knob 89 includes ribs 90 formed therein to enable the user to partially rotate knob 89 with respect to pawl carrier 88 through an approximately ninety degree excursion defined by the rotational limitation attributable to spring loaded pin 96 abutting portions of pawl carrier 88 at **88*a* as knob 89 is rotated with respect to pawl carrier 88. Output shaft 86 is integrally formed as a part of pawl carrier 88 and extends through a bore in housing 80 at 92. A flat portion 86*a* on output shaft 86 mates with shaft adapter 84. Pawl carrier 88 is secured within housing 80 by lock ring 94 that engages an annular ring (not shown) in output shaft 86**.

Referring now to FIG. 8, the operation of ratchet mechanism will be more fully discussed. Rotation of knob 89 with respect to pawl carrier 88 rotates cylindrical portion 92, which is integral with knob 89, and urges spring loaded pin 96 to rotate thereby moving double pawl member 98 about pivot point 100. Double pawl member 98 is disposed in a void within housing 80. Pivot point 100 is a shaft that is attached to or integrally formed with pawl carrier 88. Double pawl member 98 includes gear teeth 102 that either ratchet over or lock with gear teeth 104. Gear teeth 104 are formed about the periphery of an interior bore of housing 80. Rotation of knob 89 with respect to pawl carrier 88 engages clockwise, counterclockwise, and free rotation operation of ratchet 76 depending upon the specific position of knob 89. Free rotation operation occurs when knob 89 is positioned so that pin 93 engages a centrally located indentation **98*a* in double pawl member 98 thereby positioning double pawl member 98 so that gear teeth 102 do not engage gear teeth 104. Ratchet operation is achieved when knob 89 is positioned at either of the rotational limits of knob 89 with respect to pawl carrier 88 (indicated at 88***a*) and double pawl member 98 is correspondingly rotated about pivot point 100, as a result of spring loaded forces from pin 96, so that either gear teeth 102 or 103 engage gear teeth 104. As shown in FIG. 8, rotation of pawl carrier 88 clockwise will transmit rotational force through gear teeth 103 and gear teeth 104 to double pawl member 98 and to housing 80. Counterclockwise rotation of pawl carrier 88 induces gear teeth 102 to "ride up" out of engagement with gear teeth 104 and a clicking sound is generated as each tooth 102 slides past gear teeth 104. Rotation of pawl carrier 88 corresponds with rotation of output shaft 86 as both are integrally formed. Ratchet 76 provides a means for releasably engaging shaft 74 to shaft 82.

Figure 13:
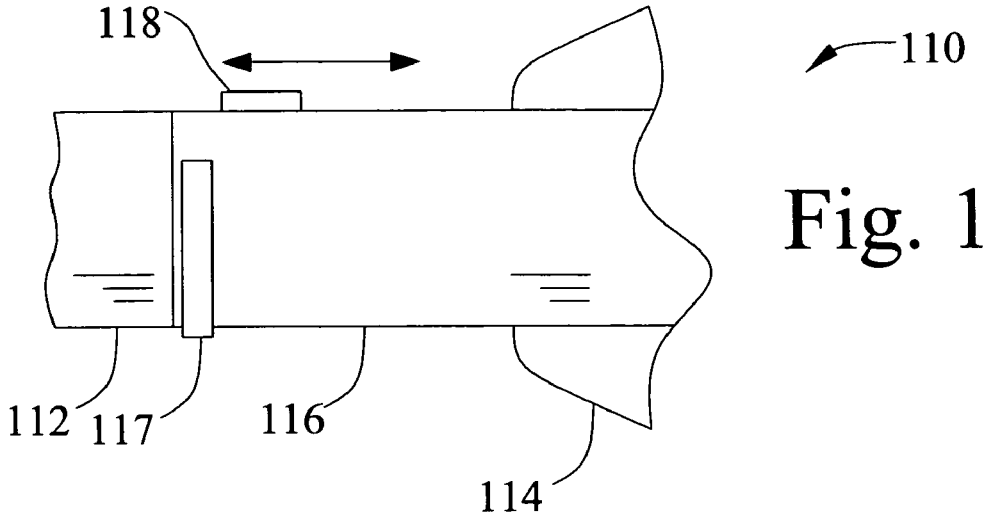
FIG. 13 is a partial elevational view of a stringed instrument tuning device according to another aspect of the present invention.

Referring now to FIG. 13, a partial front elevational view of a tuning device 110 according to another aspect of the present invention is shown. Device 110 includes worm gear shaft 112 that corresponds functionally with and extends from the worm gear shaft 16 or 44 of the prior art. Tuning knob 114 is fixedly attached to tuning shaft 116. Control knob 118 is movable axially along shaft 116 to engage and disengage rotation of shaft 116 with shaft 112. Retaining c-clip 117 secures tuning shaft 117 to shaft 112 in a freely rotatable fashion.

Figure 14:
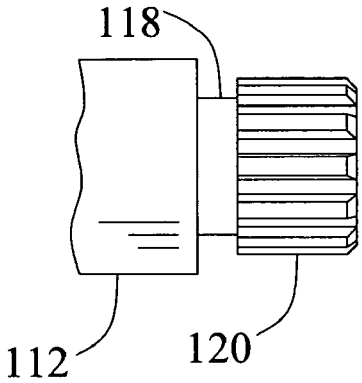
FIG. 14 is a partial elevational view of the worm gear shaft of FIG. 13.
Figure 15:
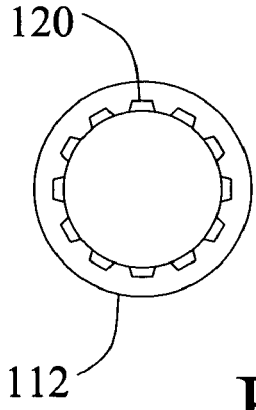
FIG. 15 is an end view of the worm gear shaft of FIG. 14.

Referring now to FIGS. 14 and 15, shaft 112 is shown in a partial front elevational view in FIG. 14 and an end view in FIG. 15. Shaft 112 includes an annular slot 118 formed therein. Shaft 112 also includes a spline gear formed integrally with shaft 112.

Figure 16:
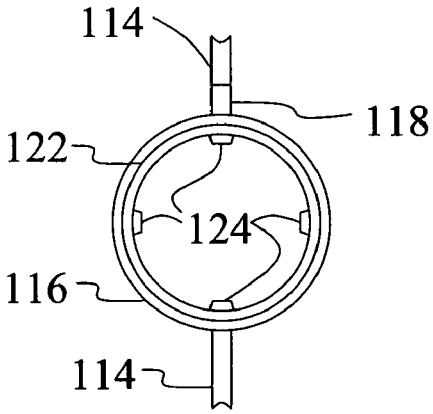
FIG. 16 is an end view of the tuning knob assembly of FIG. 13.
Figure 17:
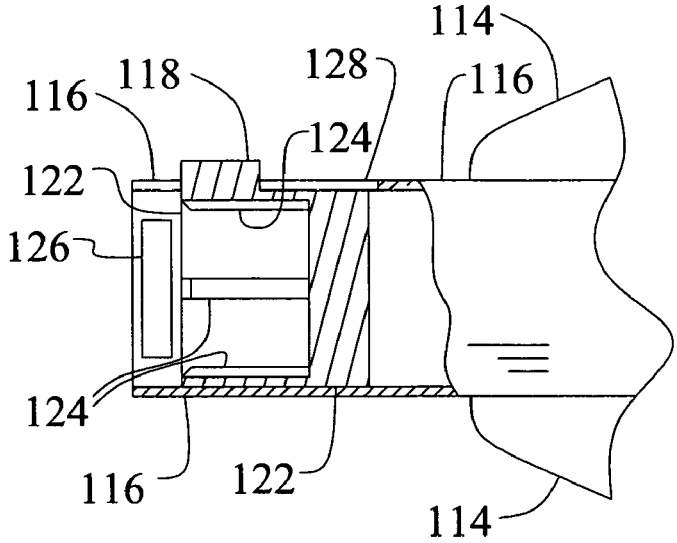
FIG. 17 is a partial cross-sectional view of the tuning knob assembly of FIG. 13.

Referring now to FIG. 16, an end view of shaft 116, and FIG. 17, a partial cut-away front elevational view of shaft 116, more details of shaft 116 are shown. Situated within the hollow end of shaft 116 is a substantially cylindrical shuttle 122 that includes knob 118 that extends through an aperture 128 in shaft 116. Shuttle 122 includes gear teeth 124 formed about the inner periphery thereof. Shaft 116 includes a pair of opposing slots or apertures 126 that align with slot 118 so that c-clip 117 rotatably attaches shaft 116 to shaft 112. Shuttle 122 is axially positionable with respect to shaft 116 so that gear teeth 124 engage spline gear 120. Alternatively, shuttle 122 is positioned axially towards knob 114 so that gear teeth 124 are disengaged from spline gear 120 internally within shaft 116. Thus device 110 provides for a mode of operation wherein knob 114 rotationally disengages from shaft 112 or alternatively positively engages shaft 112 in accordance with the position of shuttle 122 so that rotational torque applied to shaft 116 via knob 114 is transmitted to shaft 112.

Figure 18:
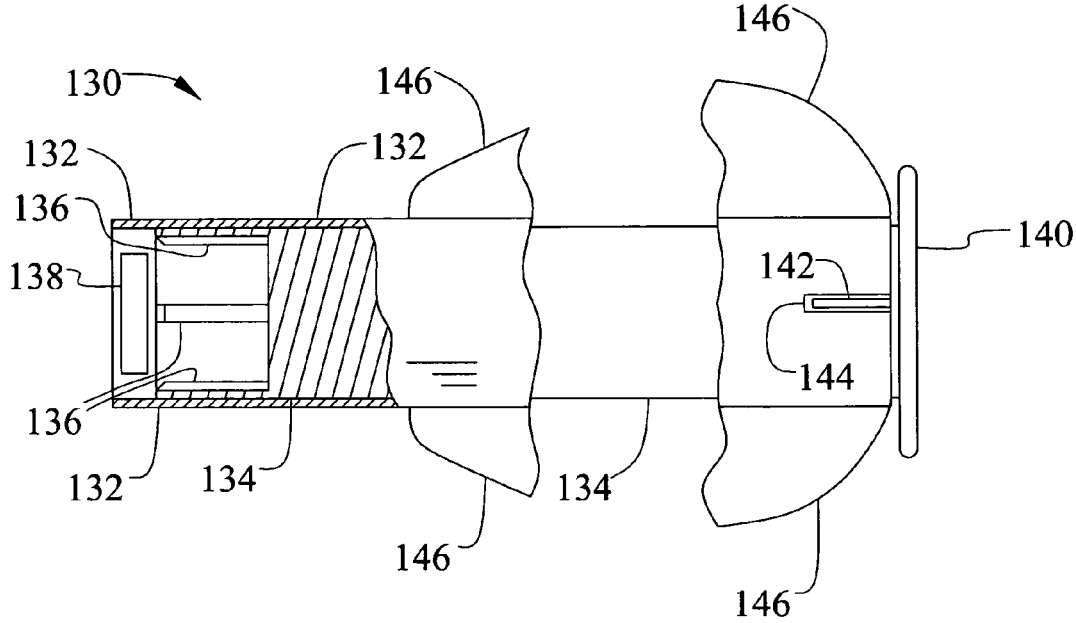
FIG. 18 is a partial cross-section elevational view of a worm gear and tuning knob assembly according to another aspect of the present invention.

Referring now to FIG. 18, an alternative aspect of the concept shown in FIGS. 13-17 is shown. FIG. 18 is a partial cross-sectional front elevational view of a tuning shaft 130 that may be substituted in place of shaft 116 and shuttle 122 in FIGS. 13-17. Device 130 includes a tuning shaft 132 that is hollow. Disposed within shaft 132 is a shuttle shaft 134. Shuttle shaft 134 includes a hollow cylindrical portion at one end where gear teeth 136 are formed about the inner periphery thereof. Shaft 134 is axially positioned with respect to tuning shaft 132 so that gear teeth 136 engage spline gear 120 or disengage from gear 120 when free rotation of knob 146 with respect to shaft 112 is desired. Shaft 132 is rotatably attached to shaft 112 with a retaining c-clip such as clip 117 of FIG. 13. Retaining clip 117 is inserted in opposing apertures 138 formed in tuning shaft 132 and engages slot 118 to retain shaft 132 rotatably with shaft 112. Only one of the two apertures 138 is shown in FIG. 18. Actuator knob 140 is fixedly attached to shuttle shaft 134 and enables the user to position shuttle shaft 134 axially within tuning shaft 132. Locking rib 142 extends radially outward from shuttle shaft 134 to engage slot 144 in tuning shaft 132 so that rotational forces applied to knob 146 are transmitted through rib 142 to shuttle shaft 134. Actuator knob 140 is axially positioned adjacent tuning knob 146 to engage gear teeth 136 with spline gear 120 and provide engagement of knob 146 to worm gear shaft 112. Positioning knob 140 axially away from knob 146 causes shuttle shaft 134 to be moved off of spline gear 120 and teeth 136 are no longer in engagement with gear 120 thereby enabling free rotation of tuning knob 146 with respect to worm gear shaft 112.

Figure 19:
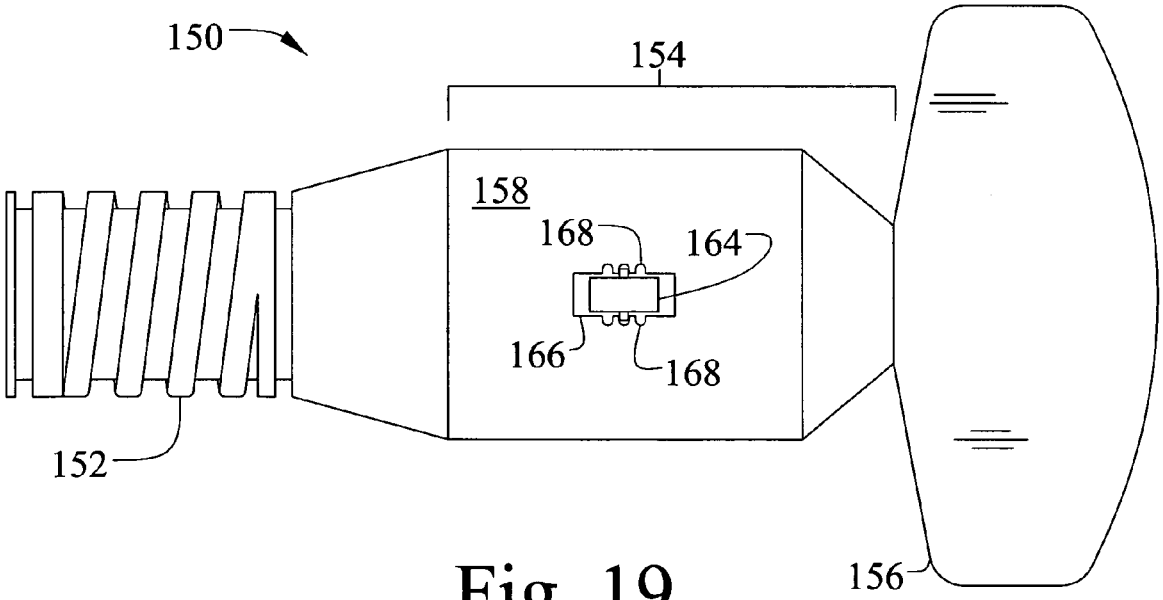
FIG. 19 is a front elevational view of a worm gear and tuning knob assembly of another stringed instrument tuning device according to another aspect of the present invention.
Figure 20:
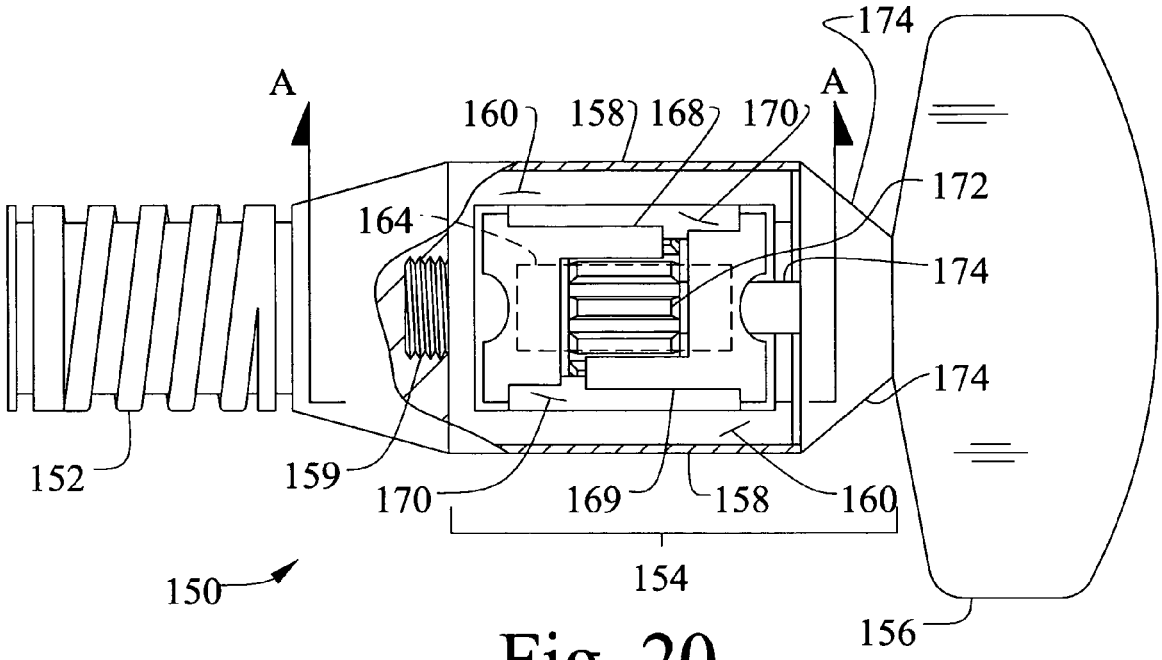
FIG. 20 is a partial cut-away plan view of the device shown in FIG. 19.
Figure 21:
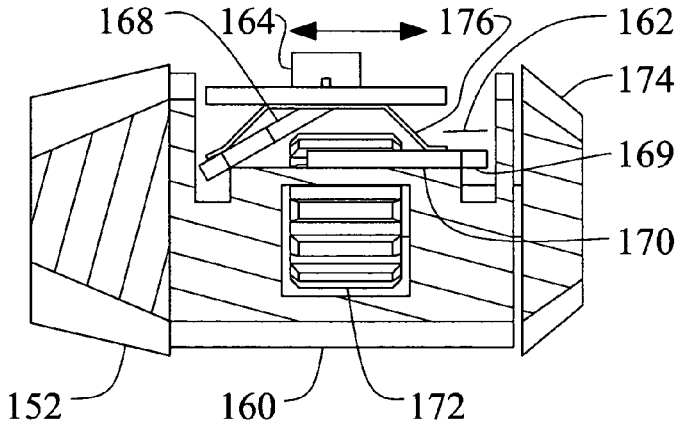
FIG. 21 is a cross-sectional view of the device shown in FIG. 20 looking in the direction of the arrows labeled A-A.

Referring now to FIGS. 19-21, an embodiment of a stringed instrument tuning device 150 according to still another aspect of the present invention is shown. FIG. 19 is a plan view, FIG. 20 is a cut-away plan view and FIG. 21 is a cross-sectional view looking in the direction of the arrows labeled A-A. Device 150 includes worm gear shaft 152 corresponding to the worm gear shafts 16 and 44 of the prior art, a ratchet mechanism 154 and a tuning knob 156. Ratchet mechanism 154 includes a cylindrical cover 158 within which a ratchet housing 160 is situated. Worm gear shaft 152 is fixedly attached to housing 160 via a threaded interface at 159. Housing 160 includes an internal void 162 within which control knob 164 is situated. Knob 164 extends radially outward through an aperture 166 in cover 158. Aperture 166 includes an array of three opposing notches or indentations 168 adapted to engage a small protrusion in knob 164 for positive positioning of knob 164 within the void 162. Situated in void 162 are pawl members 168 and 169. Pawl members 168 and 169 abut shelves 170 formed in housing 160. Shelves 170 provide a vertical support to position pawl members adjacent and in engagement with the teeth of spline gear 172 so that rotation of spline gear 172 transmits the rotational forces from the teeth of gear 172 through pawl members 168 and 169 to housing 160. When knob 164 is axially moved from the center position shown in FIG. 19 toward shaft 152, spring member 176 applies a downward force to pawl member 168 as shown in FIG. 21. In the inclined position shown in FIG. 21, pawl member 168 no longer engages the teeth of gear 172 so that gear 172 is rotatable freely in one rotational direction. Free rotation of spline gear 172 in the opposing direction is achieved by axially moving knob 164 toward knob 156 thereby causing force from spring member 176 to incline pawl member 169 and simultaneously causing spring member 176 to urge pawl member 168 into a horizontal position adjacent shelf 170. Rotational forces applied to shaft 174 are transmitted through gear 172 which engages pawl members 168 or 169. Gear 172 is integrally machined in and forms a part of shaft 174. Forces applied to pawl members 168 or 169 are transmitted to housing 160 in the form of rotational force.

Operational speaking, positioning knob 164 in a middle position so that pawl members 168 and 169 are both adjacent shelf 170 results in both clockwise and counterclockwise forces applied to tuning knob 156 being transmitted through ratchet mechanism 154 to worm gear shaft 152. Positioning knob 164 in either of the remaining axially extreme positions results in the ability to rotate tuning knob 156, either clockwise or counterclockwise depending on the specific position of knob 156, without rotating shaft 152 and yet providing a means to transmit rotational force through ratchet mechanism in the opposite rotational direction to shaft 152. Thus, device 150 enables positioning of tuning knob 156 without affecting the rotational position of worm gear shaft 152 in 2 of three operational modes of ratchet mechanism 154. The ratchet mechanism 154 shown in FIGS. 19-21 is a common mechanism often found in ratcheting screwdrivers.

It is contemplated that any of the great variety of ratchet style mechanisms of the prior art that releasably engage one drive shaft to another shaft may be used with or adapted for use with the present invention. Further, the shuttle and spline gear approaches shown in FIGS. 13-18 are merely two of the multitude of shuttle like engaging-disengaging mechanisms that may be adapted for use with stringed instrument tuning devices to enable rotation of the tuning knob to align all of the tuning knobs as desired after tuning of the stringed instrument is completed. For example, a pivoting lever may be adapted for use in the present invention wherein the lever is pivotally attached along an axis perpendicular to and non-intersecting with the axis of the tuning shaft 132 and is pivotally positionable in one position with one or more teeth to engage the teeth of spline gear (120) thereby engaging the tuning shaft (116) to the worm gear shaft (112) or pivotally positionable away from the gear to enable free rotation of the tuning knob versus the worm gear shaft 112. Such an approach would replace the shuttle 122 approach of device 118.

The materials used in the construction of the stringed instrument tuning devices of the present invention are typical of the art, such as steel for screws, brackets and ratchet components and brass for pinion and worm gear shafts or other suitable materials well known in the art and commonly used for construction of such devices.

A primary benefit of the present invention is the ability to align the tuning knobs after tuning the instrument so that inadvertent physical contact with the knobs that causes detuning of the strings is readily ascertained by visual inspection of the tuning knob positions. A further benefit of the present invention is realized when the user is able to align all the tuning knobs in identical positions after tuning the musical instrument. Letters or designs applied to the tuning knobs are then perfectly aligned so that any message thereon is properly conveyed to the observer viewing the musical instrument.

While the invention has been illustrated and described in detail in the drawings and foregoing description of the preferred embodiments, the same is to be considered as illustrative and not restrictive in character, it being understood that only the preferred embodiments have been shown and described and that all changes and modifications that come within the spirit of the invention are desired to be protected.

What is claimed is:

1. A stringed instrument tuning device comprising:

a pinion gear;

a tuning shaft having a first end and a second end and wherein a transverse aperture is situated near said first end for receiving a wire string;

a worm gear adapted to engage said pinion gear;

a bracket having a first aperture therein, and wherein said second end of said shaft is situated in said first aperture and said pinion gear is attached to said tuning shaft so that said bracket is rotatably captured between said gear and said shaft, said bracket further including worm gear mounting means for rotatably attaching said worm gear to said bracket in a position to engage said pinion gear;

means for rotating said worm gear, said means for rotating attached to said worm gear, said means for rotating positively engaging said worm gear in a first mode of operation, and wherein said means for rotating freely rotates with respect to said worm gear in a second mode of operation; and a tuning knob attached to said means for rotating.

2. The device of claim 1 wherein said means for rotating is a ratchet device having an input and an output shaft and wherein said input shaft is attached to said tuning knob and said output shaft is attached to said worm gear, and wherein said ratchet device includes a control lever positionable in one of two positions wherein in a first position the ratchet enables clockwise rotation of said worm gear while allowing free counter-clockwise rotation of said tuning knob with respect to said worm gear, said ratchet device further enabling counter-clockwise rotation of said worm gear while allowing free clockwise rotation of said tuning knob when said control lever is positioned in a second position.

3. The device of claim 2 wherein said control lever is positionable in a third position to enable free rotation of said tuning knob with respect to said worm gear in either a clockwise or a counter-clockwise direction.

4. The device of claim 2 wherein said control lever is positionable in a third position to positively engage said tuning knob to said worm gear in either a clockwise or a counter-clockwise direction of rotation.

5. The device of claim 1 wherein said means for rotating comprises:

a spur gear attached to said worm gear;

a knob shaft having a first end, a second end, and a hollow portion at said second end, and wherein said tuning knob is attached to said first end, and wherein said knob shaft is rotatably attached to said worm gear at said second end so that said spur gear is situated within said hollow portion, said knob shaft also having an aperture in the lateral surface thereof that communicates with said hollow portion; and a gear shuttle disposed within said hollow portion of said knob shaft, said gear shuttle including in internal spline gear sized to engage said spur gear, and wherein said gear shuttle includes a tab protrusion that extends outward through said aperture in said knob shaft, and wherein said gear shuttle is positioned within said aperture by moving said tab protrusion axially toward said spur gear to a first position wherein said internal spline gear of said shuttle engages said spur gear, said shuttle being positionable in a second position by moving said tab axially away from said worm gear so that said gear shuttle is disengaged from said spur gear and said knob shaft rotates freely with respect to said worm gear and said spur gear.

6. A stringed instrument tuning device comprising:

a pinion gear;

a tuning shaft having a first end and a second end including means situated near said first end adapted for receiving a wire string;

a worm gear;

a planar bracket having worm gear mounting means extending outward therefrom and adapted to rotatably receive said worm gear, said planar bracket further including a shaft aperture and wherein said pinion gear is disposed on one side of said shaft aperture in engaging position with said worm gear and said tuning shaft is attached to said worm gear through said shaft aperture so that said pinion gear and said tuning shaft are rotatably fixed in position with respect to said bracket and said worm gear;

rotating means fixedly attached to said worm gear for providing a rotational force to said worm gear for tensioning the wire string, said rotating means further being capable of rotatably disengaging from said worm gear while still attached thereto so that said rotating means may be rotatably positioned while said worm gear remains in a fixed angular position; and a tuning knob means attached to said rotation means for enabling a user to readily supply a rotational force to said rotation means.

7. The device of claim 6 wherein said rotating means is a ratchet device having an input and an output shaft and wherein said input shaft is attached to said tuning knob means and said output shaft is attached to said worm gear, and wherein said ratchet device includes a control lever positionable in one of two positions wherein in a first position the ratchet enables clockwise rotation of said worm gear while allowing free counter-clockwise rotation of said tuning knob with respect to said worm gear, said ratchet device further enabling counter-clockwise rotation of said worm gear while allowing free clockwise rotation of said tuning knob when said control lever is positioned in a second position.

8. The device of claim 7 wherein said control lever is positionable in a third position to enable free rotation of said tuning knob with respect to said worm gear in either a clockwise or a counter-clockwise direction.

9. The device of claim 7 wherein said control lever is positionable in a third position to positively engage said tuning knob to said worm gear in both a clockwise and a counter-clockwise direction of rotation.

10. The device of claim 6 wherein said rotating means comprises:

a spur gear attached to said worm gear;

a knob shaft having a first end, a second end, and a hollow portion at said second end, and wherein said tuning knob means is attached to said first end, and wherein said knob shaft is rotatably attached to said worm gear at said second end so that said spur gear is situated within said hollow portion, said knob shaft also having a control knob aperture in the lateral surface thereof that communicates with said hollow portion; and a gear shuttle disposed within said hollow portion of said knob shaft, said gear shuttle including in internal spline gear sized to engage said spur gear, and wherein said gear shuttle includes a tab protrusion that extends outward through said control knob aperture in said knob shaft, and wherein said gear shuttle is positioned within said aperture by moving said tab protrusion axially toward said spur gear to a first position wherein said internal spline gear of said shuttle engages said spur gear, said shuttle being positionable in a second position by moving said tab axially away from said worm gear so that said gear shuttle is disengaged from said spur gear and said knob shaft rotates freely with respect to said spur gear.

* * * * *